US005464322A

United States Patent [19]

Cunha et al.

[11] Patent Number: 5,464,322

[45] Date of Patent: Nov. 7, 1995

[54] COOLING CIRCUIT FOR TURBINE STATOR VANE TRAILING EDGE

[75] Inventors: Francisco J. Cunha, Schenectady; David A. De Angelis, Voorheesville, both of N.Y.

[73] Assignee: General Electric Company, Schenectady, N.Y.

[21] Appl. No.: 294,670

[22] Filed: Aug. 23, 1994

[51] Int. Cl.[6] ..... F01D 9/06; F01D 5/18

[52] U.S. Cl. ..... 415/115; 416/96 R

[58] Field of Search ..... 415/115, 116; 416/96 R, 96 A, 97 R, 97 A, 92

[56] References Cited

U.S. PATENT DOCUMENTS 4,456,428 6/1984 Cuvillier ..... 415/115
5,253,976 10/1993 Cunha .

FOREIGN PATENT DOCUMENTS 0198305 10/1985 Japan ..... 416/97 R
0264706 11/1991 Japan ..... 415/115

OTHER PUBLICATIONS

"Advanced Cooling First Stage Vane Design", Levari et al., ASME 84–GT–219.

"Flow In Corners of Passages with Non–Circular Cross–Sections", Eckert et al.; ASME Paper, Aug. 22, 1955.

*Primary Examiner*—Edward K. Look
*Assistant Examiner*—Christopher Verdier
*Attorney, Agent, or Firm*—Nixon & Vanderhye

[57] ABSTRACT

A cooling circuit is provided for the second stage nozzle of a gas turbine. Cooling medium such as air is supplied into a chamber for flow through openings in an impingement plate for impingement cooling of the trailing edge. Convection air is supplied to the trailing edge for combining with the impingement flow. Both series and parallel arrangements of cooling circuits are provided for the aft portion of the vane.

18 Claims, 5 Drawing Sheets

Fig. 5
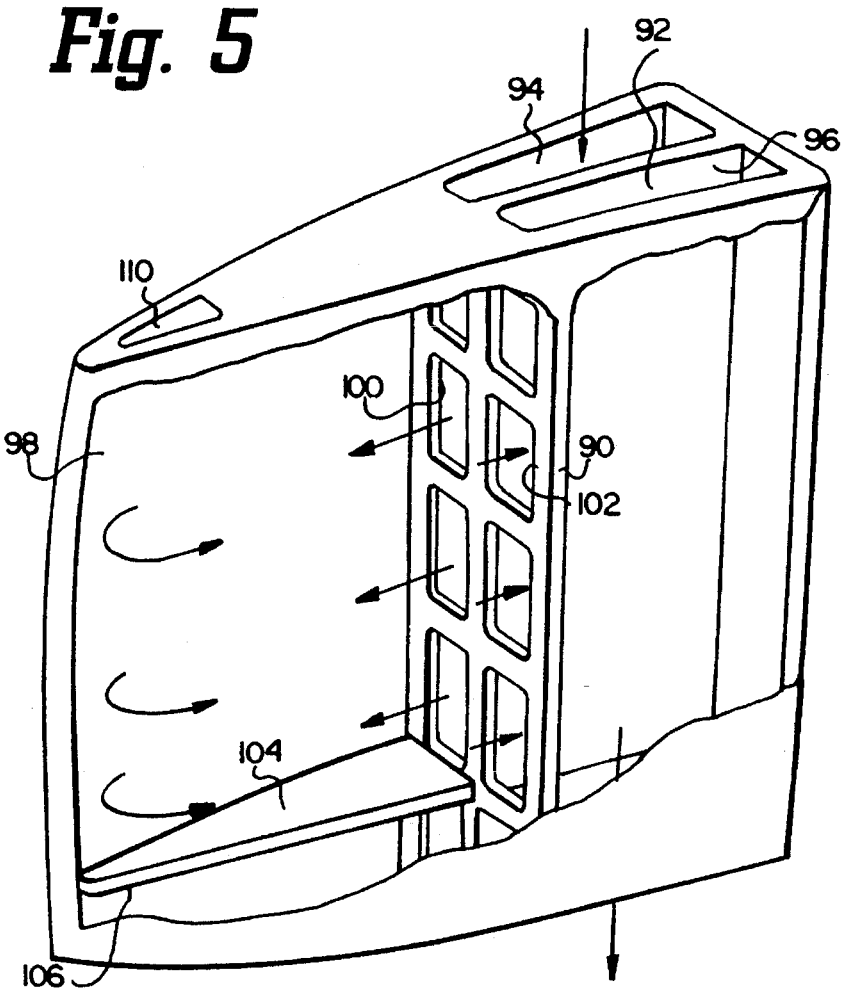
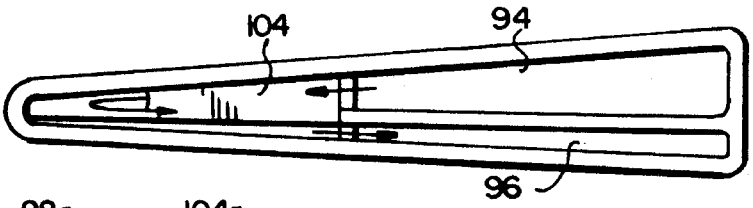
Fig. 6A
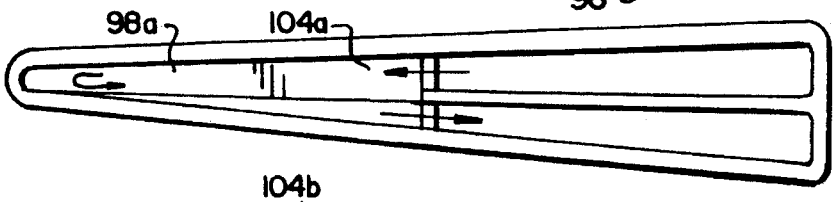
Fig. 6B
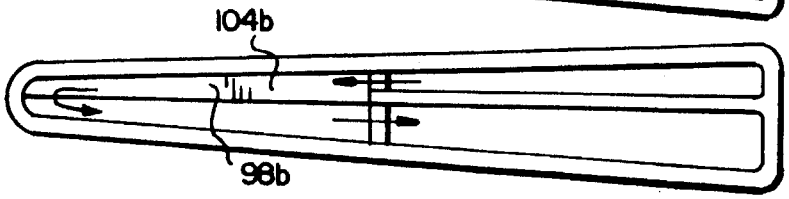
Fig. 6C

COOLING CIRCUIT FOR TURBINE STATOR VANE TRAILING EDGE

TECHNICAL FIELD

The present invention relates to a cooling arrangement for the trailing edge of a stator vane nozzle and particularly to an air cooling arrangement for the trailing edge of a stator vane useful downstream of the first stage of the turbine.

BACKGROUND

The traditional approach for cooling turbine blades and nozzles is to extract high pressure cooling air from a source, for example, by extracting air from the intermediate and last stages of a turbine compressor. In modern turbine designs, it has been recognized that the temperature of the hot gas flowing past the turbine components could be higher than the melting temperature of the metal. It is, therefore, necessary to establish a cooling scheme to protect hot gas path components during operation. In combined cycle plants, steam may be the preferred cooling medium. While diverted coolant air, for example, from the compressor, does not receive energy directly from the combustor of the turbine and represents a parasitic loss to turbine output degrading overall performance, it has been found useful to combine steam cooling and air cooling in a nozzle stage of the turbine after the first turbine stage. Impingement air cooling of stator vanes is, per se, known. However, impingement air cooling degrades as cross-flow increases. It is, therefore, desirable to minimize the magnitude of the cooling air flow required for trailing edge cooling.

DISCLOSURE OF THE INVENTION

In accordance with the present invention, stator vanes, preferably for the second nozzle stage, are each provided with a plurality of generally radially extending cavities between opposite ends of the vanes. The cavities forwardly of the trailing edge cavity preferably carry steam for cooling the stator vane. Thus, steam flowing in two or more of those cavities radially inwardly from the radially outermost end of the vane cools the vane and returns by another of the cavities to an exhaust conduit adjacent the outer end of the vane. The aft cavity, however, is impingement air cooled. To minimize degradation of cooling caused by cross-flows in the impingement cooling air streams, a combination of impingement cooling and convection air cooling is provided in the aft cavity of the trailing edge. To accomplish this and in one form of the present invention, the radially extending aft cavity adjacent the trailing edge of the blade is divided into first and second chambers by a divider, for example, a rib or a plate, which extends between the opposite side walls of the vane. In a preferred embodiment, the member comprises a plate having a plurality of apertures or openings for communicating air from one side of the plate to the opposite side. The first chamber lies in communication with an air inlet adjacent the radially outer end of the vane. The inlet also supplies air to a secondary inlet between the vane and the trailing edge whereby the plate divides the cavity into first and second chambers. Preferably, the plate is inclined within the cavity. Particularly, the plate inclines forwardly from the radial outer inlet of the vane adjacent the trailing edge to a location adjacent the forward end of the cavity at the radially inner end of the vane. Consequently, the air inlet at the radially outer vane end supplies air to a first chamber for flow through the openings in the plate into the second chamber and hence for impingement cooling flow against the trailing edge. Inlet air is also supplied between the radially outer end of the inclined plate and the trailing edge to provide a convection flow generally radially inwardly along the vane. The second chamber increases in volumetric capacity in a radially inward direction because of the inclination of the plate. Consequently, as the flow proceeds radially inwardly, additional mixing takes place within the cavity adjacent the trailing edge whereby the impingement cooling degrades in a radially inward direction while convection cooling increases in that direction.

While the foregoing air cooling arrangement is satisfactory, it is recognized that impingement cooling is generally more effective than forced convection cooling without impingement cooling. Therefore, to increase the efficiency of the impingement cooling, and in another embodiment of the present invention, there is provided a divider, i.e., a rib, dividing the aft cavity into forward and rearward portions. A series of chambers are provided at generally corresponding radial locations in each of the forward and aft portions separated from one another by generally axially extending ribs. The rib separating axially adjacent chambers includes a plurality of openings for flowing cooling air from the forward chambers into the aft chambers. Each of the aft chambers has an outlet through the rib for flowing cooling air from the aft chamber to a successive forward chamber in a radially inward direction. Air is inlet to the forward chamber and also adjacent the trailing edge into the second chamber adjacent the radially outer end of the vane. As a consequence of this arrangement, the cooling air flows serially back and forth between the forward and aft chambers in a radial inward direction. Particularly, air flows into the first chamber and through the openings in the rib for impingement cooling of the trailing edge. The impingement cooling air combines with the convection air inlet to the second chamber for flow through the outlet into a third chamber radially aligned with the first chamber. The cooling air in the third chamber then flows through impingement openings into the fourth chamber in radial alignment with the second chamber for impingement cooling of the trailing edge. The cooling air flows through the outlet into a fifth chamber and into successive chambers whereby it will be appreciated that a series type cooling air flow circuit is provided. An outlet is provided adjacent the radially innermost portions of the vanes for flowing the air into the turbine wheel cavities.

In a further embodiment of the present invention, a similar series flow is maintained through forward and aft portions of the aft cavity. In this form, however, the outlet from the second, fourth, sixth chambers, etc., is located forwardly of the apertured rib and the rib is located closer to the trailing edge to increase the efficiency of the impingement cooling.

In another embodiment of the present invention, a parallel flow cooling arrangement is provided. In this form, the aft cavity is divided by a rib defining a forward portion comprised of a cooling air inlet supply passage which extends from a cooling air inlet at the radially outer end of the vane to a cooling air outlet adjacent the radially inner end of the vane. An aft portion of the cavity is disposed between the trailing edge and the rib. An exhaust passage lies to one side of the inlet passage forwardly of the aft portion and which similarly extends between the opposite ends of the vane. Independent cooling openings in the ribs supply cooling air from the inlet passage into the aft cavity portion. Exhaust openings are also formed in the rib to one side of the inlet openings whereby air passes through the inlet openings into the aft cavity portion and is exhausted through the exhaust openings into the exhaust passage. A plurality of chambers are located within the aft cavity portion and are radially spaced from one another. Each chamber lies in communication with the inlet passage through a set of the impingement cooling openings. Likewise, those additional chambers lie in communication with the exhaust passage through additional openings in the ribs which radially separate the chambers from one another. Consequently, the cooling air flows into the inlet passage and into each of the chambers through the inlet openings for impingement cooling of the trailing edge. The cooling air then flows through the exhaust openings in the rib into the exhaust passage. Additional convection cooling air is provided by the passageways directly between the aft chambers. To facilitate the cooling air flow, the inlet passage decreases in volumetric capacity in a radial inward direction while the exhaust passage increases in volumetric capacity in a radial inward direction.

In a preferred embodiment according to the present invention, there is provided an air cooling circuit for the trailing edge of a stator vane comprising an airfoil shaped stator vane body having a plurality of internal cavities extending substantially between opposite ends of the body for flowing a cooling medium, one of the cavities extending along the trailing edge of the stator vane body, a divider extending along the one cavity dividing the one cavity into respective forward and rear passages along opposite sides of the divider, the divider having a plurality of openings, an inlet to the one cavity for flowing cooling air into the passages and an outlet for the cavity for exhausting the cooling air, the cooling air flowing into the rear passage from the inlet being directed along the trailing edge of the vane affording convection cooling of the trailing edge of the vane and the cooling air flowing into the forward passage from the inlet being directed through the openings in the divider for impingement cooling of the trailing edge of the vane.

In a further preferred embodiment according to the present invention, there is provided an air cooling circuit for the trailing edge of a stator vane comprising an airfoil shaped stator body having a plurality of internal cavities extending substantially between radially opposite ends of the vane body for flowing a cooling medium therethrough, one of the cavities extending along the trailing edge of the stator vane body and being defined in part by a divider extending between opposite side walls of the vane body dividing the stator vane body into first and second chambers with the second chamber defined in part by the trailing edge and the first chamber lying forwardly thereof, a cooling air inlet to the first chamber, the divider having a plurality of openings therethrough for communicating cooling air from the first chamber into the second chamber and impingement cooling of the trailing edge of the stator vane body.

Accordingly, it is a primary object of the present invention to provide a novel and improved air cooling arrangement for the trailing edge of a stator vane nozzle.

BRIEF DESCRIPTION OF THE DRAWINGS

FIG. 5 is a view similar to FIG. 3 illustrating a still further embodiment of the present invention; and FIGS. 6*a*, 6*b* and 6*c* are schematic representations of the cross section of the aft cavity taken at the tip, mid and root portions of the vane.

BEST MODE FOR CARRYING OUT THE INVENTION

Figure 1:
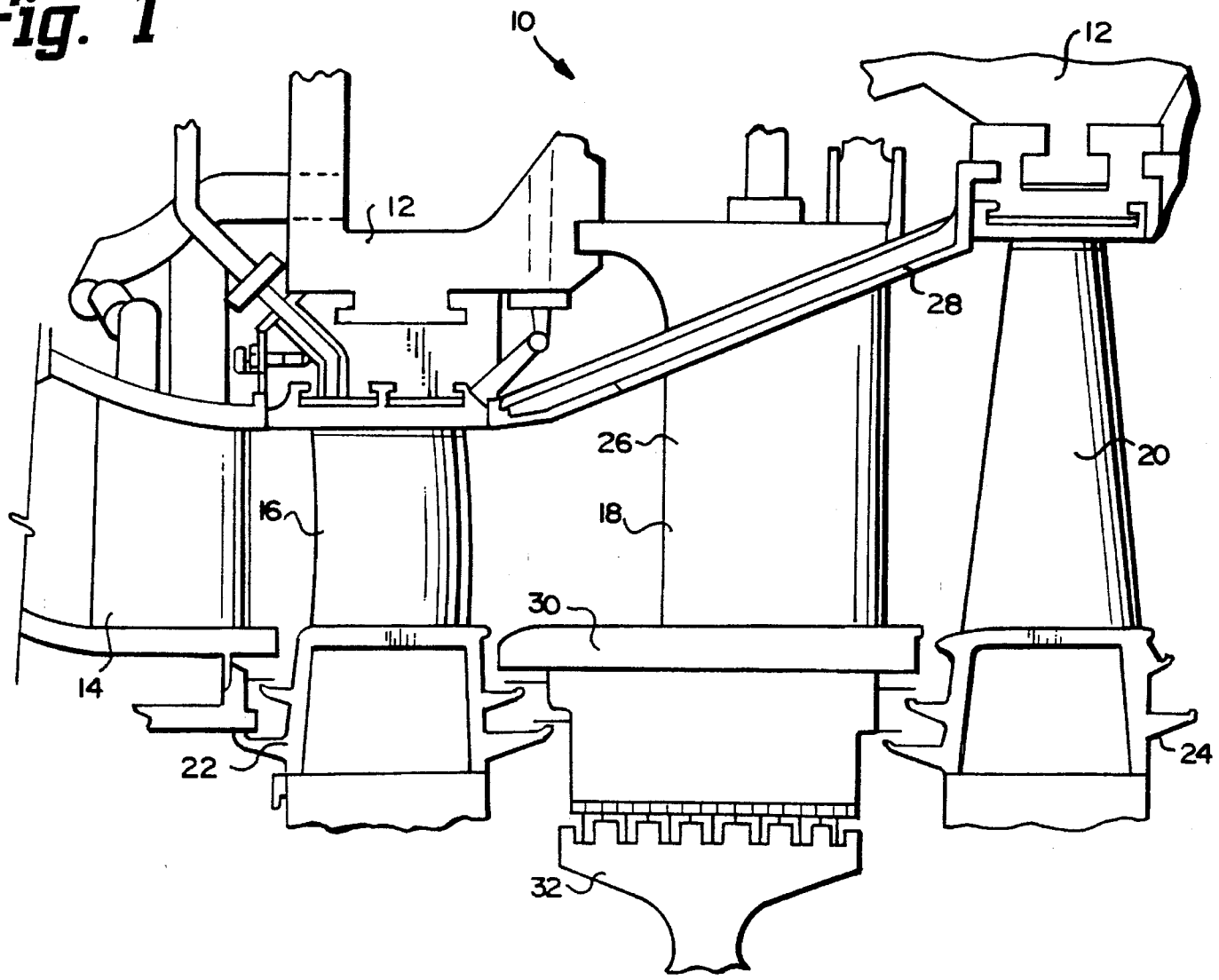
FIG. 1 is a fragmentary side elevational view of a portion of a turbine illustrating first and second stage turbine buckets and first and second stage stator vanes.
Figure 2:
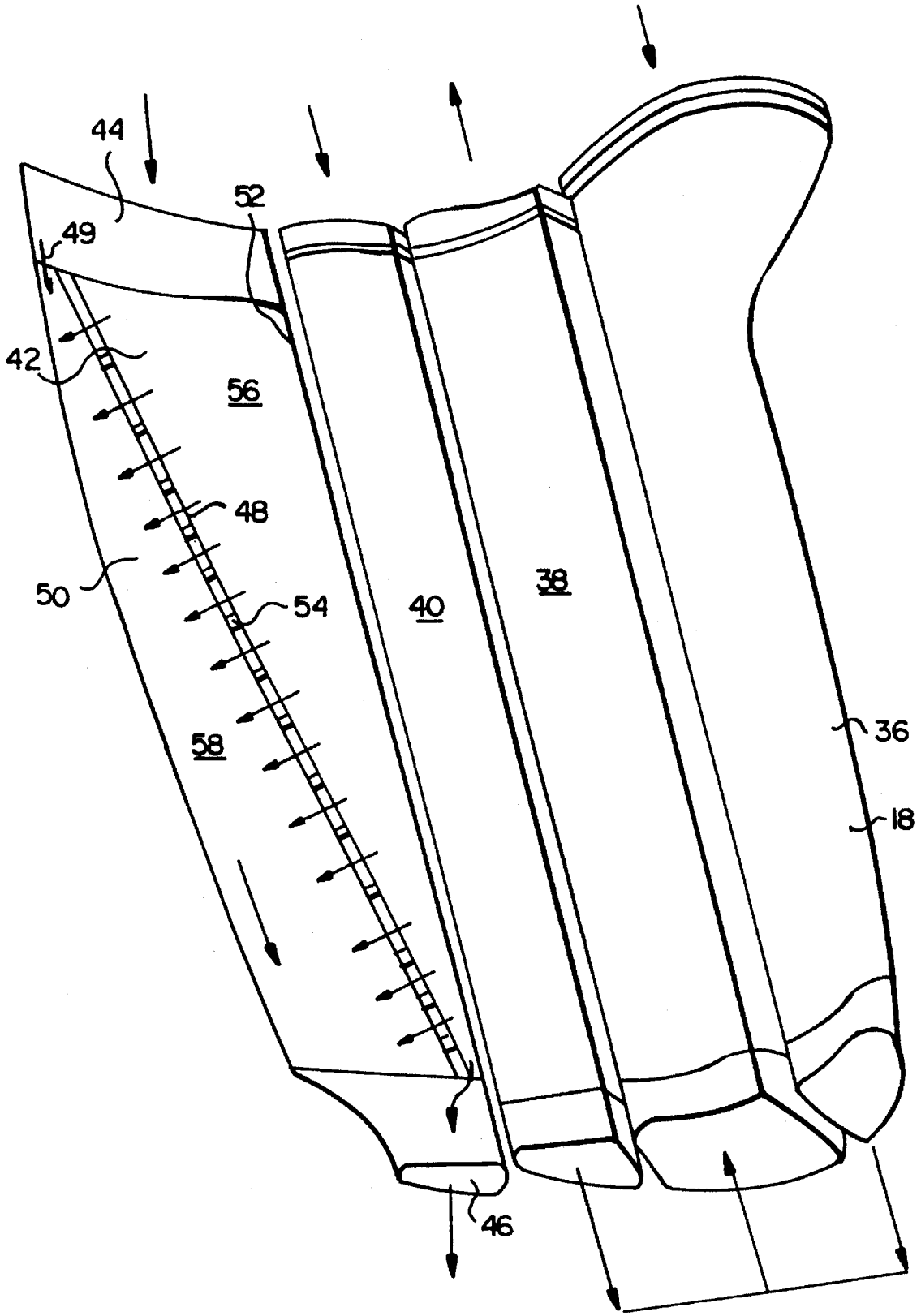
FIG. 2 is a perspective view of the second stage stator vane schematically illustrating the cavities for steam and air cooling of the vane.

Referring now to FIG. 1, there is illustrated a portion of a gas turbine generally designated 10 having an inner shell 12 surrounding the various stages of the turbine. For example, turbine 10 includes a first stage nozzle 14, a first stage of turbine buckets 16, a second stage nozzle 18, and a second stage of turbine buckets 20. It will be appreciated that the buckets 16 and 20, respectively, are mounted on pedestals 22 and 24 which in turn are mounted on turbine wheels not shown for rotation about the turbine axis. The second stage nozzle 18 includes a plurality of radially extending vanes 26 circumferentially spaced one from the other and extending generally radially inwardly from an outer side wall 28 to an inner side 30 to which a diaphragm 32 is secured. It will be appreciated that hot gases of combustion from the turbine combustors, not shown, flow generally axially, for example, from left to right in FIG. 1 through the first stage nozzles 14 for driving the first turbine stage of turbine buckets 16 and which gas then flows through fixed second stage 18 for driving the second stage of turbine buckets 20. As schematically represented in FIG. 2, the second stage stator vanes 18 are divided into a plurality of cavities 36, 38, 40 and 42. The forward and intermediate cavities 36 and 38, 40, respectively, provide for flow of a cooling medium, for example, steam. Preferably, cooling steam flows radially inwardly through the forward cavity 36 and intermediate cavity 40 for return through another intermediate cavity 38.

In a first embodiment hereof, aft cavity 42 conducts cooling air from an inlet 44 to an outlet 46 at the radially inner end of the vane. A divider, preferably a flat plate 48, extends between opposite side walls of the vane within cavity 42 and is inclined relative to the trailing edge 50. Thus, the plate 48 is secured at the radially outer end of the vane closely adjacent to trailing edge 50 and spaced from the forward wall 52 of the cavity and extends radially inwardly and inclines relative to the trailing edge 50 to a location closely adjacent to the forward wall 52 and spaced forwardly from the trailing edge 50. The plate 48 includes a plurality of openings 54. As a consequence, the aft cavity 42 is divided into first and second chambers 56 and 58, respectively, on opposite sides of plate 48. Cooling air is supplied through inlet 44 into both chambers 56 and 58 with the major portion of the air being inlet to first chamber 56. The air flowing into chamber 56 flows through the openings 54 for impingement cooling of the trailing edge 50. The small portion of the air flowing directly into the aft or second chamber 58 via orifice 49 flows radially inwardly for convection cooling of the trailing edge 50 and combines with the impingement air for flow to outlet 46. It will be appreciated, however, that the cross-flow effects of the post-impingement air flowing toward the outlet 46 as well as the convection air flow degrades the effectiveness of the impingement cooling toward the radially inner end of the vane. Thus, the cooling adjacent the radially inner end of the vane is provided less by impingement cooling and more by convection cooling in comparison with the cooling effect at the trailing edge adjacent the radially outer end of the vane.

Figure 3:
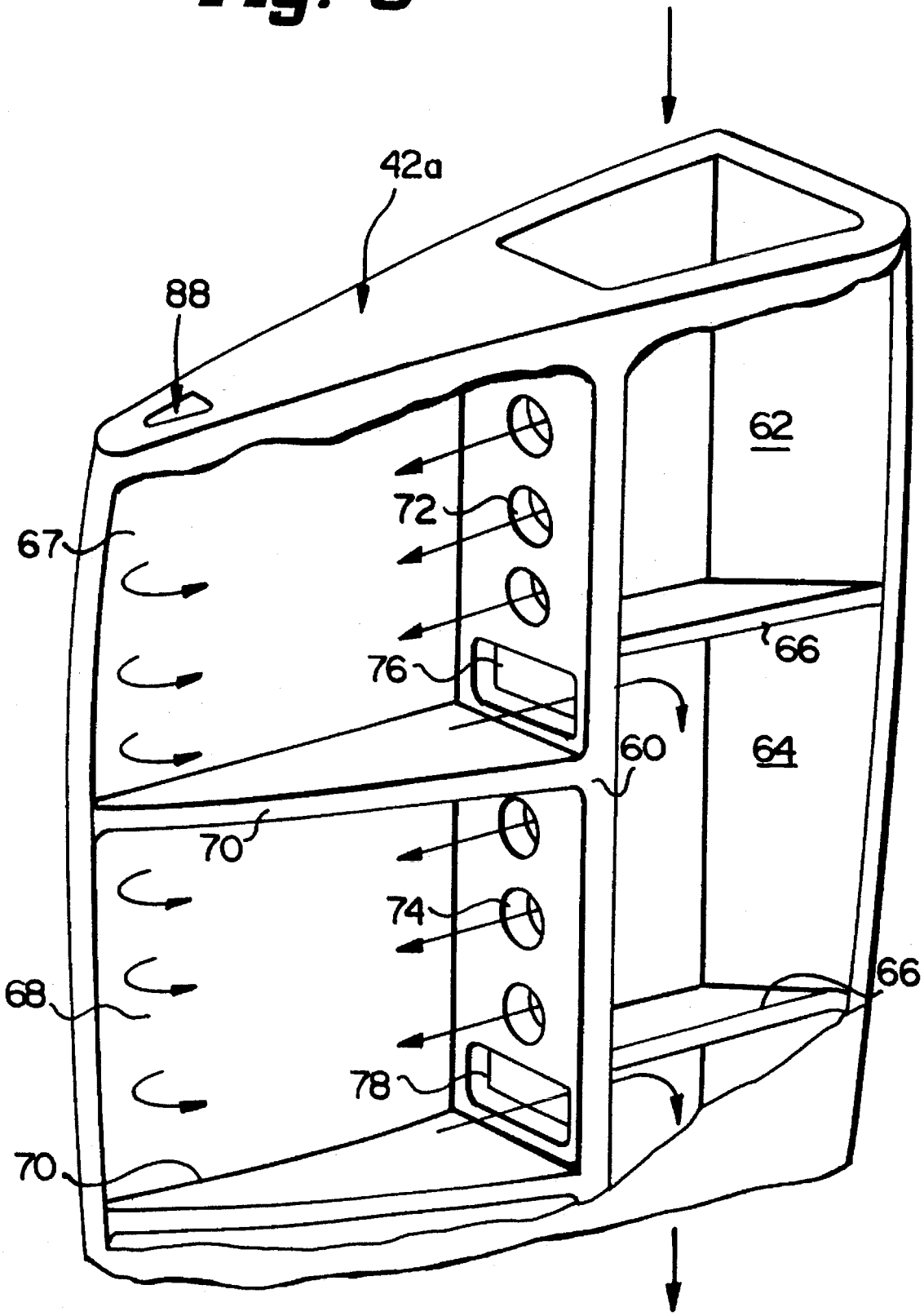
FIG. 3 is a perspective view of a portion of the trailing edge cavity.

To increase the efficiency of the impingement cooling of the trailing edge, reference is made to FIG. 3 wherein a series cooling arrangement is provided. In FIG. 3 the aft cavity 42*a* is divided into various chambers. For example, the cavity is divided by a central divider, e.g., a rib 60, extending between opposite side walls of the vane, dividing the vane into forward and rear portions each having radially spaced chambers. Thus, first, third and succeeding chambers are spaced radially inwardly relative to one another and separated by ribs 66. Second, fourth and succeeding chambers are provided in a radially inward direction in the aft portion of aft cavity 42*a* separated by ribs 70. A first set of openings 72 are provided in rib 60 to provide communication between first and second chambers 62 and 67, respectively. A second set of cooling openings 74 provide communication between third chamber 64 and fourth chamber 68. Additional sets of openings are provided through the rib 60 at radially inward locations to provide communication between the additional forward and rear chambers. Further, an outlet 76 is provided between second chamber 67 and third chamber 64 and an outlet 78 is provided between fourth chamber 68 and the fifth chamber radially inwardly of chamber 64. Additional outlets are provided similarly as needed. Consequently, it will be appreciated that cooling air inlet to the forward portion of the aft cavity into the first chamber 62 flows through openings 72 for impingement cooling of the trailing edge. Additionally convection cooling air is supplied at inlet portion 88 for mixing with the impinging cooling air. The combined convection and impingement cooling air flows into third chamber 64 through exhaust opening 76. The cooling air then flows from third chamber 64 through openings 74 into the fourth chamber 68 for impingement cooling of the trailing edge. The cooling air then flows through outlet 78 into the fifth chamber and into succeeding chambers similarly as previously described. Thus, it will be seen that the cooling air flows serially between the forward and aft chambers in generally serpentine fashion and in a generally radially inward direction.

Figure 4:
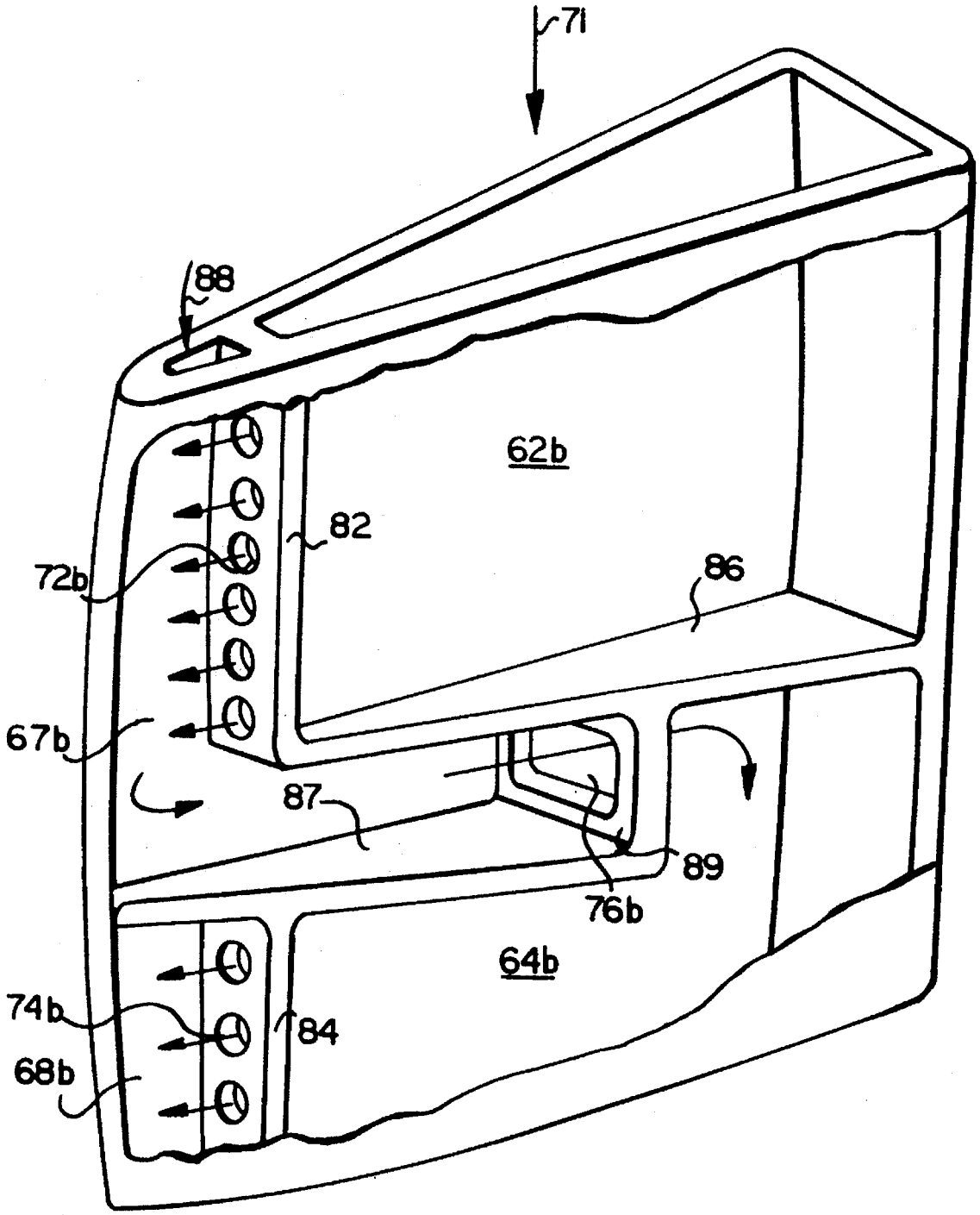
FIG. 4 is a view similar to FIG. 3 illustrating a further embodiment of the present invention.

Referring now to FIG. 4, there is illustrated a further form of a series cooling air flow circuit for the trailing edge. Similar chambers are provided in this circuit as in the circuit of FIG. 3. Thus, first and third chambers 62*b* and 64*b* and subsequent chambers lie at radially spaced positions relative to one another in the forward portion of the aft cavity. Second and fourth chambers 67*b* and 68*b* and subsequent chambers radially inwardly thereof are disposed adjacent the trailing edge. The first and second chambers and the third and fourth chambers, as well as similarly situated subsequent chambers are separated one from the other by divider ribs 82, 84, e.g., radially extending ribs, which are located more closely to the trailing edge of the vane than the rib 60 of the previous embodiment. The rib 82 has an axial extension 86 which forms a dividing wall between the first and second chambers, as well as between the first and third chambers. Likewise, rib 84 has an axial extension 87 which separates the second and third chambers, as well as the second and fourth chambers. Outlet openings 76*b* in wall portion 89 extending between rib extensions 86 and 87 communicate between the second and third chambers, the fourth and fifth chambers and so on. Consequently, air supplied through inlet 71 into the first chamber 62*b* flows through the openings 72*b* in rib 82 for impingement cooling of the trailing edge in chamber 67*b*. Additional convection air flow is supplied by way of inlet 88 to the second chamber 67*b*. The combined cooling air flow exhausts through outlet 76*b* into third chamber 64*b* for flow through openings 74*b* into the fourth chamber 68*b* for impingement cooling of the trailing edge. The post-impingement cooling flow then flows through the outlet of the fourth chamber 68*b* into the fifth chamber and so on. Thus, the cooling air flows in series between the chambers with the impingement cooling openings lying closely adjacent the trailing edge.

Referring now to the embodiment hereof illustrated in FIGS. 5 and 6*a–c*, the aft cavity of the vane includes forward and rearward portions separated by a divider, e.g., rib 90. The forward portion is divided by a rib 92 to define side-by-side cooling air inlet and outlet passages 94 and 96, respectively. The aft portion includes a second chamber 98 which is supplied with impingement cooling air through openings 100 in rib 90 communicating between inlet passage 94 and chamber 98. Chamber 98 in turn communicates with exhaust passage 96 by way of openings 102 through rib 90. An axially extending rib 104 separates the chamber 98 from a radially inward adjacent chamber 106. Additional chambers, e.g., 98*a*, 98*b*, are disposed radially inwardly of chamber 98 separated by additional ribs, e.g., ribs 104*a* and 104*b*. The ribs 104, 104*a* and 104*b*, as illustrated in FIGS. 6*a*, 6*b* and 6*c*, are secured along one side to a wall of the vane while the opposite side is spaced from the opposite wall of the vane. Thus, the chambers 98 and similarly situated radially inward chambers are in direct communication one with the other through the passageways formed between the vane wall and the respective ribs. Consequently, it will be appreciated that cooling air is supplied inlet passage 94 and flows through openings 100 into each of the radially spaced chambers 98 for impingement cooling of the trailing edge. Convection air is also supplied through an inlet 110 into chamber 98 for combining with the post-impingement cooling air for exhaust through openings 102 in rib 90 in exhaust passage 96. In the chambers 98*a*, 98*b*, etc., radially inwardly of chamber 98, the cooling air is similarly supplied through openings 100 in the rib and exhausted through openings 102 into the exhaust passageway. Thus, the cooling air flow is supplied in essentially a parallel arrangement into each of the aft chambers for impingement cooling, although some convection cooling air will flow directly between the cooling chambers by way of the passageways defined by the ribs 104, 104*a*, 104*b*, etc., and the side walls of the vane.

As best seen in FIGS. 6*a*, 6*b* and 6*c*, the inlet passages 94 decrease in volumetric capacity in a radially inward direction. Conversely, the exhaust passage 96 increases in volumetric capacity in a radial inward direction. To accomplish this, the rib 92 may be inclined in a radially inward direction toward the side wall in part defining the passage 94.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims. For example, though the cooling medium has been described herein as being air, other media such as steam may be more appropriate in certain applications.

What is claimed is:

1. A cooling circuit for a trailing edge of a radially extending stator vane comprising:

an internal cavity extending generally radially along the trailing edge of the stator vane for flowing a cooling medium;

a divider dividing the cavity into respective forward and rear chambers along opposite sides of said divider, said divider having a plurality of openings;

radially outer first and second inlets to said cavity for flowing the cooling medium into said chambers; and a radially inner outlet for said cavity for exhausting the cooling medium, the cooling medium flowing into said rear chamber from said first inlet being directed along the trailing edge of the vane affording convection cooling thereof and the cooling medium flowing into the forward chamber from said second inlet being directed through said openings in said divider for flow into said rear chamber for impingement cooling of the trailing edge of the vane, the convection and impingement cooling flows in said rear chamber being combined for flow through said radially inner outlet.

2. A cooling circuit according to claim 1 wherein said divider is arranged within said cavity such that the volume of the rear and forward chambers increases and decreases, respectively, in the direction of flow of the cooling medium from said inlets to said outlet.

3. A cooling circuit according to claim 1 wherein said divider is arranged within said cavity in increasing distance from said trailing edge in a direction from a radially outer end of said vane to a radially inner end of said vane.

4. A cooling circuit according to claim 1 wherein said divider comprises a generally flat plate arranged within said cavity such that the volume of the rear and forward chambers increase and decreases, respectively, in the direction of flow of the cooling medium from said inlets to said outlet.

5. A cooling circuit for a trailing edge of a radially extending stator vane comprising:

a closed internal cavity extending substantially between radially opposite ends of said vane for flowing a cooling medium therethrough, said cavity extending along the trailing edge of said vane and being defined in part by a divider extending between opposite side walls of said vane, thereby dividing said vane into first and second chambers with said second chamber defined in part by said trailing edge and said first chamber lying axially forwardly thereof;

a radially outer cooling medium inlet to said first chamber of said closed cavity;

said divider having a first plurality of openings therethrough for communicating cooling medium from said first chamber into said second chamber and impingement cooling of the trailing edge of said vane; and a radially inner cooling medium outlet from said second chamber for flowing spent cooling medium from said cavity.

6. A cooling circuit according to claim 5 including a first rib extending generally axially between the opposite side walls of said vane further defining said second chamber, a second rib extending generally axially between opposite side walls of said vane further defining said first chamber, an outlet for cooling medium from said second chamber formed adjacent a radially inward end of said second chamber and radially inwardly of the openings through said divider, said second rib joining said divider at a location between said outlet and said openings segregating said first chamber from cooling medium passing through said outlet.

7. A cooling circuit according to claim 5 including a convection cooling medium inlet to said second chamber for flowing convection cooling medium into said second chamber.

8. A cooling circuit according to claim 5 including third and fourth chambers, said fourth chamber defined in part by said trailing edge and lying radially inwardly of said second chamber, said third chamber lying forwardly of said fourth chamber and radially inwardly of said first chamber, an outlet for said second chamber for communicating cooling medium from said second chamber into said third chamber, a second divider between said third and fourth chambers, said second divider having a second plurality of openings therethrough for communicating cooling medium from said third chamber into said fourth chamber and impingement cooling of the trailing edge of said stator vane whereby the cooling medium flows in series through the first, second, third and fourth chambers.

9. A cooling circuit according to claim 5 wherein said first chamber extends substantially between radially opposite ends of said vane and is divided by a chordwise rib into a cooling medium inlet passage, and a cooling medium outlet passage, said divider having a first set of exhaust openings for flowing cooling medium from said second chamber into said outlet passage.

10. A cooling circuit for a the trailing edge of a radially extending stator vane comprising:

an internal cavity extending substantially between radially opposite ends of said vane for flowing a cooling medium therethrough, said cavity extending along the trailing edge of said vane and being defined in part by a divider extending between opposite side walls of said vane, thereby dividing said vane into first and second chambers with said second chamber defined in part by said trailing edge and said first chamber lying axially forwardly thereof;

a cooling medium inlet to said first chamber;

said divider having a first plurality of openings therethrough for communicating cooling medium from said first chamber into said second chamber and impingement cooling of the trailing edge of said vane;

a first rib extending generally axially between the opposite side walls of said vane further defining said second chamber, a second rib extending generally axially between opposite side walls of said vane further defining said first chamber, an outlet for cooling medium from said second chamber formed adjacent a radially inward end of said second chamber and radially inwardly of the openings through said divider, said second rib joining said divider at a location between said outlet and said openings segregating said first chamber from cooling medium passing through said outlet.

11. A cooling circuit according to claim 10 including third and fourth chambers, said fourth chamber being defined in part by said trailing edge and lying radially inwardly of said second chamber, said third chamber lying forwardly of said fourth chamber and radially inwardly of said first chamber, the outlet from said second chamber communicating the cooling medium from said second chamber into said third chamber radially inwardly of said second rib, said divider having a second plurality of openings therethrough for communicating cooling medium from said third chamber into said fourth chamber for impingement cooling of the trailing edge of said stator, and a cooling medium outlet from said fourth chamber.

12. A cooling circuit for the a trailing edge of a radially extending stator vane comprising:

an internal cavity extending substantially between radially opposite ends of said vane for flowing a cooling medium therethrough, said cavity extending along the trailing edge of said vane and being defined in part by a divider extending between opposite side walls of said vane, thereby dividing said vane into first and second chambers with said second chamber defined in part by said trailing edge and said first chamber lying axially forwardly thereof;

a cooling medium inlet to said first chamber;

said divider having a first plurality of openings therethrough for communicating cooling medium from said first chamber into said second chamber and impingement cooling of the trailing edge of said vane;

third and fourth chambers in said vane, said fourth chamber defined in part by said trailing edge and lying radially inwardly of said second chamber, said third chamber lying forwardly of said fourth chamber and radially inwardly of said first chamber, an outlet for said second chamber for communicating cooling medium from said second chamber into said third chamber, a second divider between said third and fourth chambers, said second divider having a second plurality of openings therethrough for communicating cooling medium from said third chamber into said fourth chamber and impingement cooling of the trailing edge of said stator vane whereby the cooling medium flows in series through the first, second, third and fourth chambers.

13. A cooling circuit according to claim 12 wherein said outlet between said second chamber and said third chamber is located in a wall portion extending between opposite side walls of said stator vane forwardly of said first and second dividers.

14. A cooling circuit for a the trailing edge of a radially extending stator vane comprising:

an internal cavity extending substantially between radially opposite ends of said vane for flowing a cooling medium therethrough, said cavity extending along the trailing edge of said vane and being defined in part by a divider extending between opposite side walls of said vane, thereby dividing said vane into first and second chambers with said second chamber defined in part by said trailing edge and said first chamber lying axially forwardly thereof;

a cooling medium inlet to said first chamber;

said divider having a first plurality of openings therethrough for communicating cooling medium from said first chamber into said second chamber and impingement cooling of the trailing edge of said vane;

said first chamber extending substantially between radially opposite ends of said vane and is divided by a chordwise rib into a cooling medium inlet passage, and a cooling medium outlet passage, said divider having a first set of exhaust openings for flowing cooling medium from said second chamber into said outlet passage.

15. A cooling circuit according to claim 14 including a third chamber disposed radially inwardly of said second chamber and rearwardly of said inlet and outlet passages, said divider having a second plurality of inlet openings therethrough for communicating cooling medium from said inlet passage into said third chamber and a second set of exhaust openings therethrough for flowing cooling medium from said third chamber into said outlet passage whereby the cooling medium flows in parallel through said second and third chambers.

16. A cooling circuit according to claim 14 wherein the inlet passage decreases in volumetric capacity in a radially inward direction from the radially outer end of said vane.

17. A cooling circuit according to claim 14 wherein the outlet passage increases in volumetric capacity in a radially inward direction from the radially outer end of said vane.

18. A cooling circuit according to claim 14 including a generally axially extending rib between said second chamber and said third chamber further defining said second chamber and said third chamber.

* * * * *